US009951764B2

(12) United States Patent
Lu et al.

(10) Patent No.: US 9,951,764 B2
(45) Date of Patent: Apr. 24, 2018

(54) HIGH-EFFICIENCY DOUBLE-INTAKE AIR PUMP

(71) Applicants: FULLING PRODUCTS CO., LTD, Changzhou, Jiangsu (CN); FULLING & CEIEC CO., LTD, Changzhou, Jiangsu (CN)

(72) Inventors: Xin Lu, Jiangsu (CN); Shihuang Wei, Jiangsu (CN); Qianjin Xiao, Jiangsu (CN); Haiying Miao, Jiangsu (CN)

(73) Assignees: FULLING PRODUCTS CO., LTD. (CN); FULLING & CEIEC CO., LTD (CN)

( * ) Notice: Subject to any disclaimer, the term of this patent is extended or adjusted under 35 U.S.C. 154(b) by 298 days.

(21) Appl. No.: 14/648,535

(22) PCT Filed: Jan. 14, 2013

(86) PCT No.: PCT/CN2013/000026
§ 371 (c)(1),
(2) Date: May 29, 2015

(87) PCT Pub. No.: WO2014/086076
PCT Pub. Date: Jun. 12, 2014

(65) Prior Publication Data

US 2015/0300350 A1 Oct. 22, 2015

(30) Foreign Application Priority Data

Dec. 3, 2012 (CN) ..... 2012 1 0508190

(51) Int. Cl.
*F04B 39/12* (2006.01)
*F04B 39/00* (2006.01)
(Continued)

(52) U.S. Cl.
CPC ..... *F04B 39/121* (2013.01); *F04B 27/1009* (2013.01); *F04B 27/1036* (2013.01);
(Continued)

(58) Field of Classification Search
CPC .... F04B 9/02; F04B 9/04; F04B 9/042; F04B 27/0821; F04B 27/0839; F04B 27/0878;
(Continued)

(56) References Cited

U.S. PATENT DOCUMENTS 5,533,870 A * 7/1996 Takenaka ..... F04B 27/1009 137/512.1
5,921,756 A * 7/1999 Matsuda ..... F04B 27/12 417/269

(Continued)

FOREIGN PATENT DOCUMENTS

CN 201106548 Y 8/2008
CN 101287891 A 10/2008

OTHER PUBLICATIONS

Written Opinion dated Jun. 6, 2013 in PCT/CN2013/000026.

(Continued)

*Primary Examiner* — Bryan Lettman
*Assistant Examiner* — Charles W Nichols
(74) *Attorney, Agent, or Firm* — Leason Ellis LLP

(57) ABSTRACT

Disclosed is a high-efficiency double-intake air pump, comprising a motor, a connector, a housing and a power assembly, and a lower horseshoe-shaped diaphragm, a lower case of a piston chamber, an upper case of a piston chamber, an upper horseshoe-shaped diaphragm, a disk-shaped air nozzle and an air nozzle protection disk, which are provided in the front end of the housing and are connected in series successively and cooperatively in an axial direction, wherein the front end of the motor is arranged in the rear end of the housing via the connector, the air nozzle protection disk is (Continued)

fixedly connected to the end face of the housing, and the power assembly comprises wave-shaped cam and couples of double-ended pistons. The air pump has an artful and compact design structure, high operation efficiency, and a low noise.

4 Claims, 7 Drawing Sheets

(51) Int. Cl.

| | |
|---|---|
| ***F04B 27/10*** | (2006.01) |
| ***F04B 27/12*** | (2006.01) |
| ***F04B 43/02*** | (2006.01) |
| ***F04B 45/027*** | (2006.01) |
| ***F04B 45/04*** | (2006.01) |

(52) U.S. Cl.
CPC ..... *F04B 27/1054* (2013.01); *F04B 27/12* (2013.01); *F04B 39/0055* (2013.01); *F04B 39/0061* (2013.01); *F04B 43/021* (2013.01); *F04B 45/027* (2013.01); *F04B 45/04* (2013.01)

(58) Field of Classification Search
CPC ..... F04B 27/0882; F04B 27/0886; F04B 27/0891; F04B 27/0895; F04B 27/1009; F04B 27/1054; F04B 27/1063; F04B 27/1081; F04B 27/12; F04B 35/04; F04B 39/0033; F04B 39/0038; F04B 39/0055; F04B 39/102; F04B 39/104; F04B 39/1073; F04B 39/108; F04B 39/12; F04B 39/121; F04B 39/123; F04B 53/001; F04B 53/002; F04B 53/06; F04B 53/10; F04B 53/1037; F04B 1/12; F04B 1/122; F04B 1/124; F04B 1/126; F04B 1/128; F04B 1/14; F04B 1/141; F04B 1/143; F04B 1/145; F04B 1/146; F04B 1/148; F04B 1/16; F04B 1/18; F04B 1/182; F04B 1/188; F04B 27/1036; F04B 39/0061
USPC ..... 181/229
See application file for complete search history.

(56) References Cited

U.S. PATENT DOCUMENTS

| | | | | |
|---|---|---|---|---|
| 2007/0140879 | A1 | 6/2007 | Huang | |
| 2008/0019844 | A1* | 1/2008 | Park | F04B 27/1018 417/269 |
| 2011/0129367 | A1 | 6/2011 | Han et al. | |

OTHER PUBLICATIONS

"International Search Report", State Intellectual Property Office of the P.R. China dated Jun. 6, 2013, PCT/CN2013/000026 (filed Jan. 14, 2013), 8 pages with English translation.

* cited by examiner

HIGH-EFFICIENCY DOUBLE-INTAKE AIR PUMP

BACKGROUND OF THE INVENTION

Field of the Invention

The present invention relates to an air pump, and more particularly to a high-efficiency double-intake air pump.

Description of Related Art

With the development of industrial technologies and the improvement of people's living standard, tyres for all kinds of vehicles and inflatable products become common in daily life, and accordingly a variety of inflator pumps have been put forward. Currently, the air pump disclosed in the prior arts generally includes a housing, a motor, an eccentric cam, a bracket, an air bag assembly, a valve seat, one-way inlet valve, a cap and an one-way outlet valve, in which the motor is arranged in the housing where an air supply hole is opened; the eccentric cam is arranged on a transmission shaft of the motor; the bracket is mounted on the housing, a throughout air inlet is defined in the bracket; the air bag assembly is fixedly supported on the bracket by the valve seat, the bottom of the air bag assembly is secured on the eccentric cam by a transmission rod, the motor and the eccentric cam propel to inflate alternately, and the one-way inlet valve is defined, corresponding to the air inlet, on the rim of the air bag assembly; a throughout air outlet is defined, corresponding to the position of the air bag of the air bag assembly, in the valve seat, and an air transmission slot is defined, corresponding to the one-way inlet valve and the air bag of the air bag assembly, in the bottom surface of the valve seat; the one-way inlet valve and the one-way outlet valve are respectively covered on the air inlet and the air outlet; the cap is fixedly covered on the valve seat, and the cap is provided with an air discharge cavity corresponding to the air outlet of the valve seat and the cap is further provided with an air outlet pipe that is communicated with the air discharge cavity. In operation, air enters the housing directly through the air supply hole of the housing, flows upwardly through the air inlet of the bracket, forces the one-way inlet valve of the air bag assembly open, and then enters the air bag through the air transmission slot of the valve seat; the motor drives the transmission rod to swing so as to make the air bag compress or expand, so that the air flows upwardly via the air outlet of the valve seat, forces the one-way outlet valve open, enters the air discharge cavity of the cap, and is discharged through the air outlet pipe to fulfill the inflation functions. This driving structure using the eccentric cam eventually causes the unbalance of the components inside the air pump, which therefore causes a strong vibration, and the vibration becomes more obvious when the motor operates at a high rotation rate, and along with the vibration, a larger noise and electronic interference are generated which results in the noise pollution to the environmental and shortens the lifespan of the air pump and reduces the working efficiency.

SUMMARY OF THE INVENTION

Technical Problem

To overcome the above deficiencies, the present invention provides an innovative air pump featured in low noise, double-intake and a high working efficiency, which completely changes the working structure and principle of the driving structure using the eccentric cam.

Technical Solution

To achieve the above objectives, the technical scheme of the present invention is described as follows.

A high-efficiency double-intake air pump includes a motor, a housing and a power assembly, and a lower horseshoe-shaped diaphragm, a lower case of a piston chamber, an upper case of a piston chamber, an upper horseshoe-shaped diaphragm, a disk-shaped air nozzle and an air nozzle protection disk, which are provided in the front end of the housing and are connected in series successively and cooperatively in an axial direction, wherein the air nozzle protection disk is fixedly connected to the end face of the housing; and an output end of the motor is arranged in the rear end of the housing via the connector;

the upper horseshoe-shaped diaphragm and the lower horseshoe-shaped diaphragm are respectively provided with an air intake control diaphragm and an air outlet control diaphragm corresponding to and in cooperation with air inlets and air outlets in the upper case of the piston chamber and the lower case of the piston chamber;

a plurality of air intake grooves are defined on a side wall of the housing;

a central cylinder is arranged at a center of an upper end face of the lower case of the piston chamber and at a center of a lower end face of the upper case of the piston chamber respectively, and couples of piston cylinders are arranged on circumference with the above axis as the center;

piston chamber air inlets and piston chamber air outlets are defined, corresponding to the piston cylinders, in the lower end face of the lower case of the piston chamber and the upper end face of the upper case of the piston chamber, a hollow pillar is further arranged on the lower case of the piston chamber, a ventilation duct vent of the hollow pillar is arranged at the lower end face of the lower case of the piston chamber, the piston chamber air outlet of the lower case of the piston chamber is communicated with the lower-end air path of the ventilation duct;

the upper end face of the upper case of the piston chamber is provided with a central air cylinder that works with the upper horseshoe-shaped diaphragm to form a central air chamber, an upper end of the hollow pillar extends upwardly and inserts into a seat hole of the ventilation duct of the hollow pillar corresponding to the upper case of the piston chamber, and an opening of the upper end of the hollow pillar is communicated with the central air chamber via an internal through hole;

the piston chamber air outlet of the upper case of the piston chamber is communicated with the central air chamber;

the power assembly includes a wave-shaped cam and couples of double-ended pistons, where the double-ended piston is movably connected to a circumferential wall of the wave-shaped cam through a sliding slot defined in the middle of the piston; the wave-shaped cam is arranged in the central chamber composed of the central cylinder of the lower case of the piston chamber and the central cylinder of the upper case of the piston chamber, the wave-shaped cam is connected axially to the motor output shaft; the double-ended piston is arranged in the piston chamber composed of the piston cylinder of the lower case of the piston chamber and the piston cylinder of the upper case of the piston chamber and moves up and down in the axial direction inside the piston chamber when the wave-shaped cam rotates; and the central air chamber outputs air through the disk-shaped air nozzle.

According to an improvement of the present invention, the present invention further includes a plurality of serpentine noise reduction paths arranged on the upper end face of the disk-shaped air nozzle, the entrance of the paths is communicated with the air intake groove defined in the side wall of the housing, the exit of the paths is communicated with the corresponding piston chamber air inlets in the upper case of the piston chamber and the upper horseshoe-shaped diaphragm. The arrangement of the serpentine paths reduces the air flow, thereby reducing the noises produced by the air flow.

According to a preferred embodiment of the present invention, the number of the piston cylinders of the lower case of the piston chamber and the number of the piston cylinders of the upper case of the piston chamber are five respectively, and are distributed evenly.

According to an improvement of the present invention, the air inlets in the upper case of the piston chamber and the lower case of the piston chamber are finger-type channel air inlets, which further reduces the noise.

According to the working principle of the present invention, a vertical piston cylinder is employed, which works to-and-fro to intake the atmospheric air through the air intake groove defined in the side wall from the bottom of the pump so as to form an intake air flow, the air flow after entering the pump is diverged into two paths of air flows, in which one path of air flow enters the corresponding piston cylinder via the corresponding air inlet in the lower case of the piston chamber of the air pump, and the other path of air flow enters the corresponding piston cylinder via the corresponding air inlet in the upper case of the piston chamber of the air pump, and the air flows are pressurized by the double-ended piston and discharged from the cylinders, then the pressurized air flows are transported through the ventilation duct to the central air chamber via the air outlets and are jetted through the air nozzles.

Advantageous Effect

The present invention has the following technical features and significant efficacy.

According to the design of the air path, an air flow is taken in through the air intake groove defined in the side wall from the bottom and discharged through the pump, which reduces the resistance to the air flow and avoids producing noise.

1. The air pump of the present invention employs the driving structure of the wave-shaped cam and couples of double-ended pistons, which is completely different from the driving structure of the eccentric cam according to the air pump of the prior arts, and overcomes the deficiencies existing in the prior arts, including the early-stage failure caused by the axial force and the radial force exerted on the motor and the strong vibration and loud noise of the air pump. The present invention improves the stability of the air pump, reduces the noise produced at a high rotation rate, and employs the wave-shaped cam to drive a plurality of double-ended pistons distributed all around the upper case and the lower case of the piston chamber to move along the axial direction of the motor inside the piston cylinder, which counteracts the axial force exerted on the motor, so that the axial force exerted on the motor is nearly null, thus expanding the lifespan of the air pump.

2. The intake air flow is diverged into two paths inside the pump, and in the meantime is compressed to generate the output air flow, which greatly improves the working efficiency of the air pump and reduces the noise.

3. The design of the divergent air paths inside air pump improves the convenience in manufacturing and increases the economic benefits.

4. The design of the air intake path adopts the serpentine noise reduction paths, which reduces the flow speed and reduces the noises of the air flow.

5. A plurality of piston cylinders may be defined in the upper case of the piston chamber and the lower case of the piston chamber and form a plurality of piston chambers, in which a central wave-shaped cam drives a plurality of pistons to work in cycles, forming a compact structure and achieving a high working efficiency, and the present invention is also characterized by the five piston chambers composed of ten piston cylinders.

LIST OF REFERENCE NUMERALS IN THE FIGURES

Figure 1:
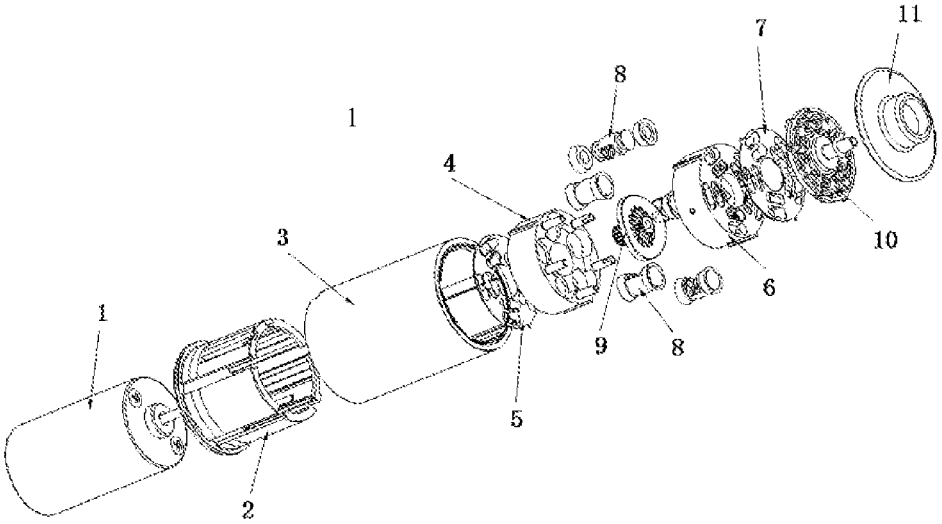
FIG. 1 illustrates an exploded structural view of the present invention.

Motor 1
Connector 2
Housing 3
Air intake groove 31
Lower case of a piston chamber 4
Hollow pillar 41
Lower piston chamber air inlet 42
Lower piston chamber air outlet 43
Lower piston cylinder 44
Ventilation duct vent of the hollow pillar 45
Lower central cylinder 46
Lower horseshoe-shaped diaphragm 5
Air outlet control diaphragm 51
Air intake control diaphragm 52
Upper case of the piston chamber 6
Seat hole of the ventilation duct of the hollow pillar 61
Upper piston chamber air outlet 62
Upper piston chamber air inlet 63
Internal through hole 64
Central air cylinder 65
Upper piston cylinder 66

Upper central cylinder 67
Upper horseshoe-shaped diaphragm 7
Double-ended piston 8
Sliding slot 81
Wave-shaped cam 9
Disk-shaped air nozzle 10
Serpentine noise reduction paths 101
Noise reduction paths entrance 102
Noise reduction paths exit 103
Air nozzle 104
Air nozzle protection disk 11
Intake air flow 12

DETAILED DESCRIPTION OF THE INVENTION

Reference will now be made in detail to the present embodiments of the invention, examples of which are illustrated in the accompanying drawings. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

To make the objectives and characteristics of the present invention comprehensive, the embodiments of the present invention are described in details with reference to the drawings. It should be explained that the drawings are simplified and are not in precise proportion, for facilitating the convenient and clear illustration purpose only.

According to the first embodiment, referring to FIG. 1, the present invention relates to a high-efficiency double-intake air pump, which includes a motor 1, a connector 2, a housing 3 and a power assembly, and a lower valve plate 5, a lower case of a piston chamber 4, an upper case of a piston chamber 6, an upper valve plate 7, a disk-shaped air nozzle 10 and an air nozzle protection disk 11, which are provided in the front end of the housing 3 and are connected in series successively and cooperatively in an axial direction, in which the front end of the motor 1 is arranged at the rear end of the housing via the connector 2, and the air nozzle protection disk 11 is fixedly connected to the end face of the housing 3.

Figure 2:
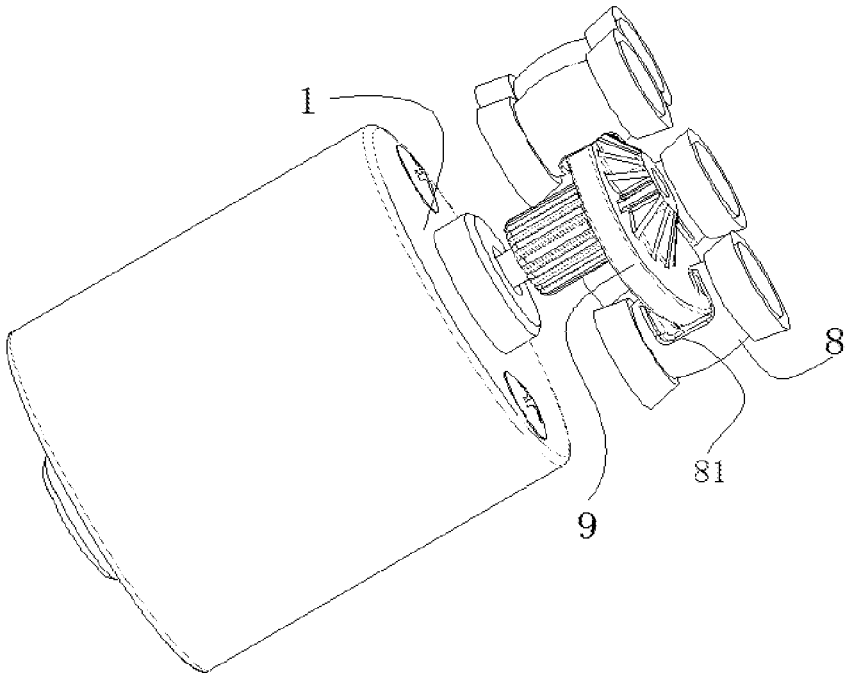
FIG. 2 illustrates a perspective view of a driving structure of the present invention.

Referring to FIG. 2, the power assembly of the present invention includes a wave-shaped cam 9 and five double-ended pistons 8, in which the output shaft of the motor 1 is connected to the wave-shaped cam 9, a middle portion of the double-ended piston 8 is provided with a sliding slot 81, and while implementing connection, the double-ended pistons are hanging on the circumferential wall of the wave-shaped cam 9 with the sliding slots 81 and swing in the axial direction along with the rotation of the wave-shaped cam 9.

Figure 3:
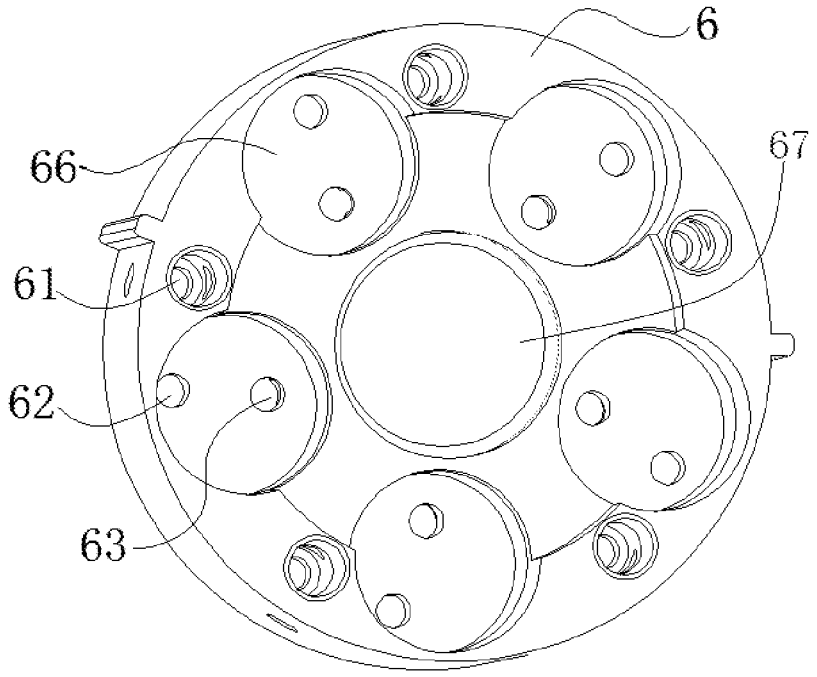
FIG. 3 illustrates a perspective view of an upper case of a piston chamber of the present invention.
Figure 4:
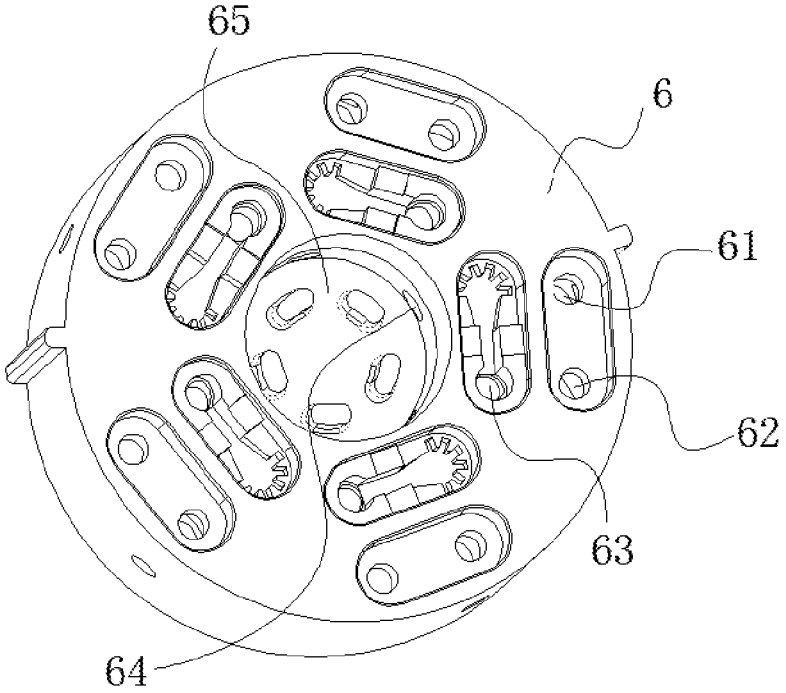
FIG. 4 illustrates a rear view of FIG. 3.

Referring to FIG. 3, an upper central cylinder 67 is arranged at the center of the lower end face of the upper case of a piston chamber 6, and five upper piston cylinders 66 are arranged on circumference with the above axis as the center, a seat hole of the ventilation duct of the hollow pillar 61 is arranged between two neighbouring upper piston cylinders 66, and an upper piston chamber air outlet 62 and an upper piston chamber air inlet 63 are arranged at the bottom of the respective upper piston cylinder 66. Referring to FIG. 4, an upper end face of the upper case of the piston chamber 6 is illustrated, in which a central air cylinder 65 is arranged at the center of the upper end face, and the central air cylinder 65 is not in communication with the central cylinder 67 at the back side, the central air cylinder 65 fits with the upper horseshoe-shaped diaphragm 7 to form a central air chamber; an internal through hole 64 is arranged in the side wall of the central air cylinder 65, and the internal through hole 64 is communicated with the upper piston chamber air outlet 62.

Figure 5:
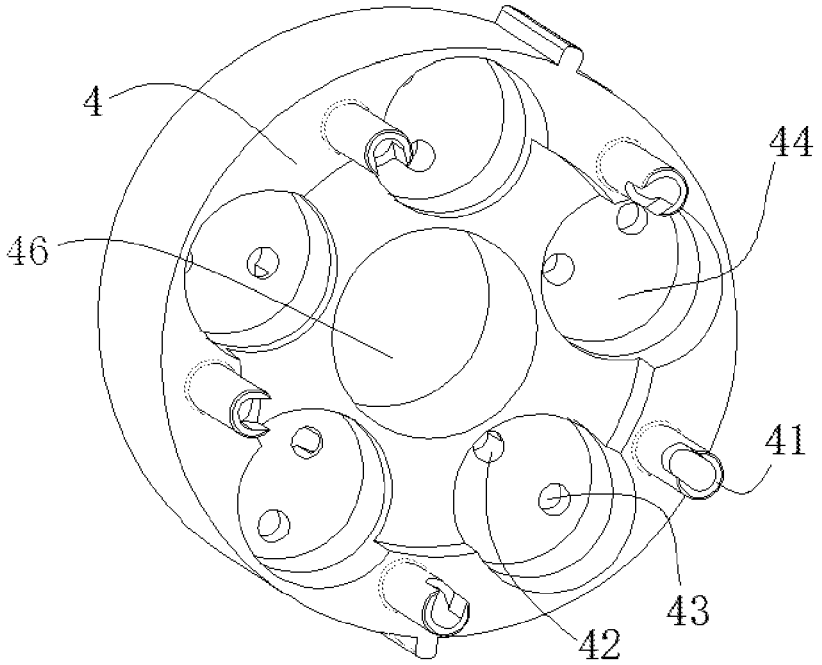
FIG. 5 illustrates a perspective view of the lower case of the piston chamber of the present invention.
Figure 6:
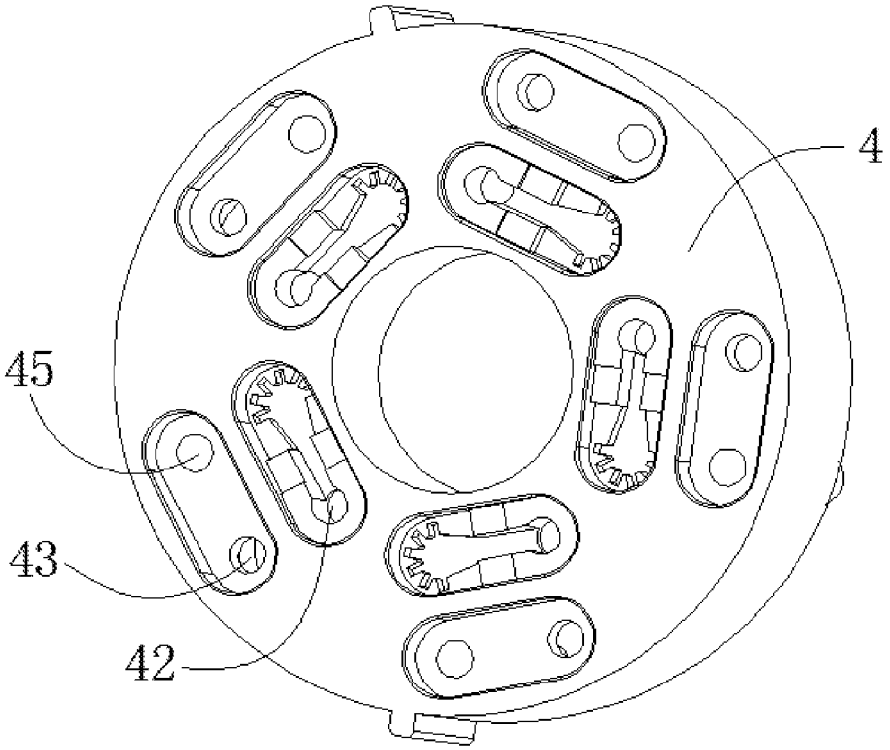
FIG. 6 illustrates a rear view of FIG. 5.

Referring to FIG. 5, a lower central cylinder 46 is arranged at the center of the upper end face of the lower case of the piston chamber 4, and five lower piston cylinders 44 are configured, corresponding to the upper piston cylinders 66, on the circumference with the above axis as the center, a hollow pillar 41 is arranged, corresponding to the seat hole of the ventilation duct of the hollow pillar 61, between two neighbouring lower piston cylinders 44, and the front end of the hollow pillar 41 has a notch; a lower piston chamber air outlet 62 and a lower piston chamber air inlet 63 are arranged at the bottom of the respective lower piston cylinder 44. Referring to FIG. 6, the lower end face of the lower case of the piston chamber 4 is provided with a ventilation duct vent of the hollow pillar 45, which is communicated with the air path of the lower piston chamber air outlet 62.

Figure 8:
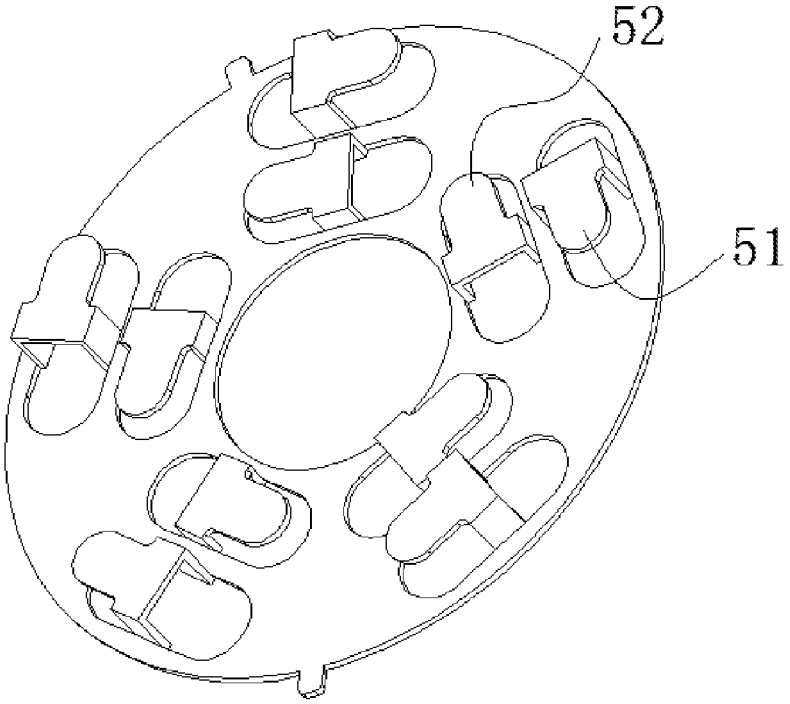
FIG. 8 illustrates a perspective view of a lower horseshoe-shaped diaphragm of the present invention.

Referring to FIG. 8, the lower horseshoe-shaped diaphragm 5 has five sets of air outlet control diaphragms 51 and air intake control diaphragms 52 corresponding to the lower piston chamber air outlets 62 and the lower piston chamber air inlets 63; the upper horseshoe-shaped diaphragm 7 has five sets of air outlet control diaphragms 51 and air intake control diaphragms 52, which is identical to FIG. 8.

Figure 9:
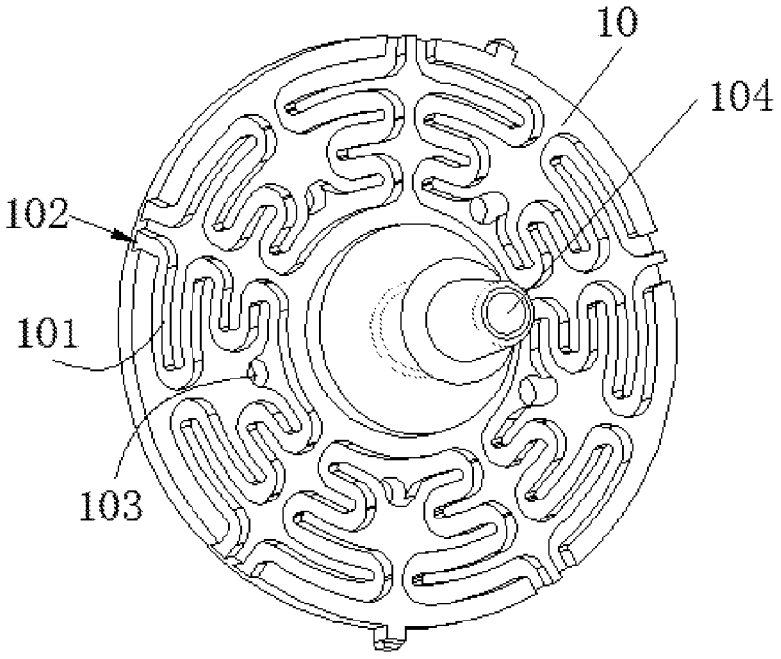
FIG. 9 illustrates a perspective view of a disk-shaped air nozzle in the present invention.

Referring to FIG. 9, an air nozzle 104 is arranged at the center of the upper end face of the disk-shaped air nozzle 10 and is communicated with the central air chamber, a plurality of serpentine noise reduction paths 101 is arranged around the air nozzle 104, the entrance of the noise reduction paths 102 is communicated with the air intake groove 31 of the side wall of the housing, and the exit of the noise reduction paths 103 is communicated with the corresponding piston chamber air inlets 63 in the upper case of the piston chamber and the upper horseshoe-shaped diaphragm.

Figure 7:
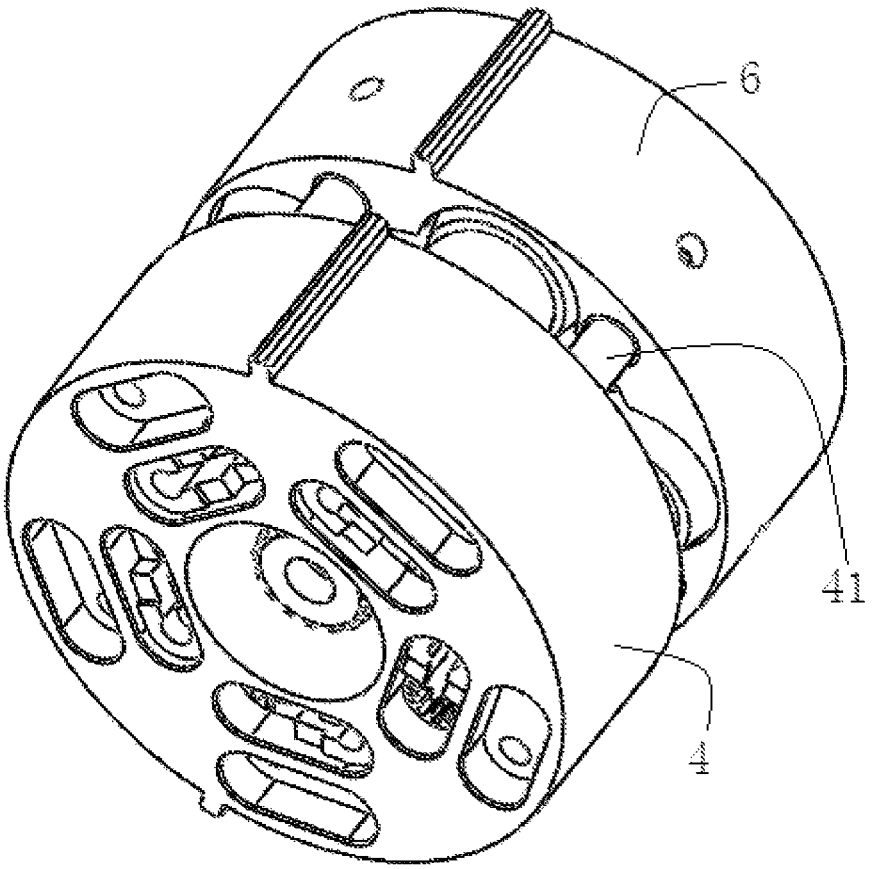
FIG. 7 illustrates an assembly view of the lower case of the piston chamber and the upper case of the piston chamber of the present invention.

Referring to FIG. 7, during the installation of the lower case of the piston chamber 4 and the upper case of the piston chamber 6, the hollow pillar 41 of the lower case of the piston chamber inserts into the seat hole of the ventilation duct of the hollow pillar 61 of the lower case of the piston chamber, and the notch of the front end of the hollow pillar 41 is communicated with the central air cylinder 65 of the upper case of the piston chamber through the internal through hole 64; the lower case of the piston chamber 4 after assembled with the upper case of the piston chamber 6, the corresponding lower piston cylinder 44 and upper piston cylinder 66 are assembled to form the piston chamber for installation of the double-ended piston 8; the lower central cylinder 46 and the upper central cylinder 67 are assembled to form the central chamber for installation of the wave-shaped cam 9, the wave-shaped cam 9 rotates inside the central chamber, and the double-ended piston 8 moves up and down inside the piston chamber along with the motion of the wave-shaped cam to compress air.

Figure 10:
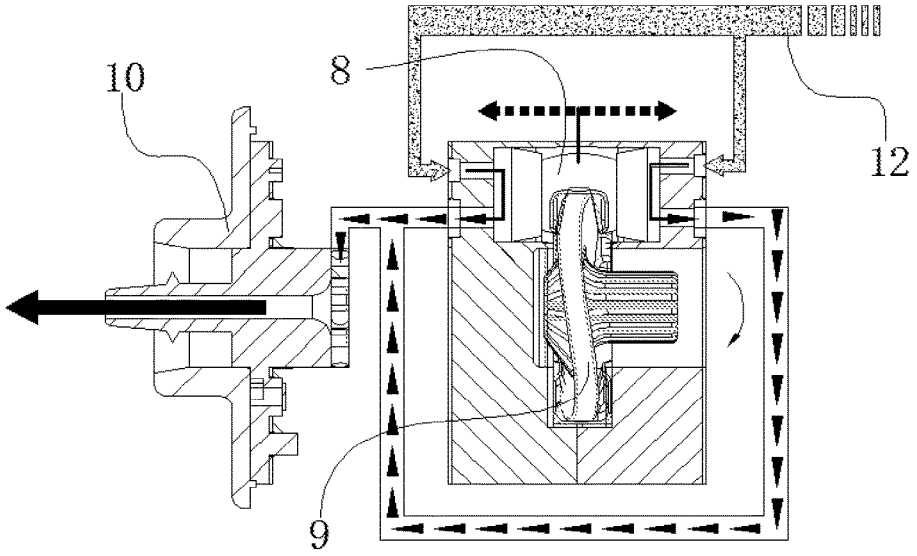
FIG. 10 illustrates a schematic structural view of air paths of the present invention.
Figure 11:
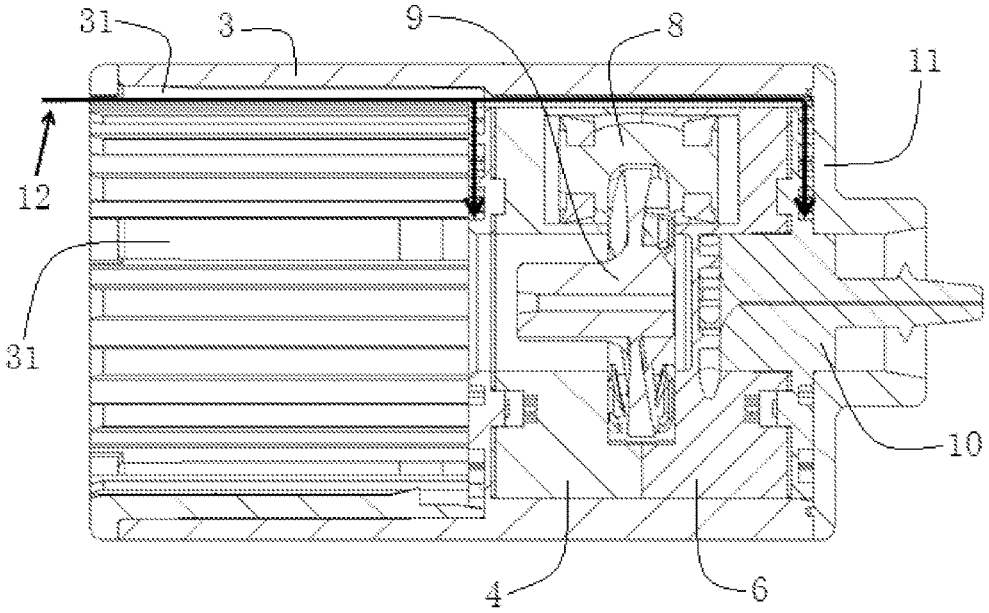
FIG. 11 illustrates an assembly view of the present invention.

Referring to FIG. 11, the housing 3 fits with the connector 2 and is formed with five air intake grooves 31 on the side wall of the housing, the air intake grooves 31 are respectively communicated with the air intake control diaphragms 51 of the upper horseshoe-shaped diaphragm 7 and the lower horseshoe-shaped diaphragm 5 through the corresponding serpentine noise reduction paths. Referring to FIG. 10 and FIG. 11, the details of the working processes of the present invention are described as follows. The motor 1 drives the wave-shaped cam 9 to rotates, drives the double-ended piston 8 to move up and down repetitively, so as to carry out the air intake and discharge working processes; when intake the air, the atmospheric air is taken in through the air intake groove 31 defined in the side wall from the bottom of the pump so as to form an intake air flow 12, the air flow after entering the pump is diverged into two paths of air flows, in which one path of air flow enters the corresponding lower piston cylinder 44 via the corresponding air inlet in the lower case of the piston chamber of the air pump, and the other path of air flow enters the corresponding upper piston cylinder 66 via the corresponding air inlet in the upper case of the piston chamber of the air pump; when discharging the air, the air in the upper piston cylinders 66 is pressurized by the double-ended piston 8, then the pressurized air flows are transported through the internal through hole 64 to the central chamber via the air outlet and are jetted through the air nozzles 104; the air in the lower piston cylinders 44 is pressurized by the double-ended piston, and the pressurized air flows enter the ventilation duct vent of the hollow pillar 45, the hollow pillar 41, the notch of the hollow pillar via the air outlet, and eventually, the pressurized air flows are transported to the central chamber via the air outlet through the internal through hole 64 in the upper case of the piston chamber and are jetted through the air nozzles.

In this embodiment, the air inlets in the upper case of the piston chamber and the lower case of the piston chamber are finger-type channel air inlets, which can further reduce the noise.

The air pump has an artful and compact design structure, high operation efficiency, and a low noise, and based on testing, the noise from the air pump disclosed in the present invention does not exceed 55 dBA maximally.

What is claimed is:

1. A high-efficiency double-intake air pump, comprising:

(i) a motor, a housing and a power assembly, and (ii) a lower valve plate, a lower case of a piston chamber, an upper case of a piston chamber, an upper valve plate, a disk-shaped air nozzle and an air nozzle protection disk, wherein the air nozzle protection disk is fixedly connected to an end face of the housing; wherein an output end of the motor is arranged in a rear end of the housing via a connector; the upper valve plate and the lower valve plate are respectively provided with an air intake control diaphragm and an air outlet control diaphragm corresponding to and in cooperation with air inlets and air outlets in the upper case of the piston chamber and the lower case of the piston chamber; wherein a plurality of air intake grooves are defined in a side wall of the housing; wherein a central cylinder is arranged at a center of an upper end face of the lower case of the piston chamber and at a center of a lower end face of the upper case of the piston chamber respectively, wherein a plurality of piston cylinders are arranged on a circumference centered around the central cylinder; wherein piston chamber air inlets and piston chamber air outlets are defined, corresponding to the piston cylinders, in a lower end face of the lower case of the piston chamber and an upper end face of the upper case of the piston chamber; wherein a hollow pillar is further arranged on the lower case of the piston chamber, wherein a vent of a ventilation duct of the hollow pillar is arranged at the lower end face of the lower case of the piston chamber, wherein the piston chamber air outlet of the lower case of the piston chamber is in communication with a lower-end air path of the ventilation duct; wherein the upper end face of the upper case of the piston chamber is provided with a central air cylinder that works together with the upper valve plate to form a central air chamber; wherein an upper end of the hollow pillar extends upwardly and inserts into a seat hole of the ventilation duct of the hollow pillar corresponding to the upper case of the piston chamber, and wherein an opening of the upper end of the hollow pillar is in communication with the central air chamber via an internal through hole; wherein the piston chamber air outlet of the upper case of the piston chamber is in communication with the central air chamber; wherein the power assembly comprises a wave-shaped cam and a plurality of double-ended pistons, where the double-ended pistons are movably connected to a circumferential wall of the wave-shaped cam through a sliding slot defined in each of the middle of the double-ended pistons; wherein the wave-shaped cam is arranged in a central chamber composed of the central cylinder of the lower case of the piston chamber and the central cylinder of the upper case of the piston chamber, wherein the wave-shaped cam is connected axially to a motor output shaft; wherein the double-ended pistons are arranged in the piston chamber composed of a piston cylinder of the lower case of the piston chamber and a piston cylinder of the upper case of the piston chamber and move up and down in an axial direction inside the piston chamber when the wave-shaped cam rotates; and wherein the central air chamber outputs air through the disk-shaped air nozzle.

2. The high-efficiency double-intake air pump according to claim 1, wherein a plurality of serpentine noise reduction paths are arranged on an upper end face of the disk-shaped air nozzle, wherein an entrance of the serpentine noise reduction paths is in communication with the plurality of air intake grooves defined in the side wall of the housing, and wherein an exit of the serpentine noise reduction paths is in communication with the corresponding piston chamber air inlets in the upper case of the piston chamber and the upper valve plate.

3. The high-efficiency double-intake air pump according to claim 1, wherein the power assembly comprises five double-ended pistons.

4. The high-efficiency double-intake air pump according to claim 1, wherein the air inlets in the upper case of the piston chamber and the lower case of the piston chamber are finger-type channel air inlets.

* * * * *